US005247797A

United States Patent [19]

Fric et al.

[11] Patent Number: 5,247,797

[45] Date of Patent: Sep. 28, 1993

[54] HEAD START PARTIAL PREMIXING FOR REDUCING OXIDES OF NITROGEN EMISSIONS IN GAS TURBINE COMBUSTORS

[75] Inventors: Thomas F. Fric, Schenectady; Masayoshi Kuwata, Ballston Lake, both of N.Y.

[73] Assignee: General Electric Company, Schenectady, N.Y.

[21] Appl. No.: 811,731

[22] Filed: Dec. 23, 1991

[51] Int. Cl.[5] ..... F02C 1/00

[52] U.S. Cl. ..... 60/737; 60/734

[58] Field of Search ..... 60/737, 734, 740, 739; 261/121.3, 121.4; 431/8, 159, DIG. 1

[56] References Cited

U.S. PATENT DOCUMENTS

| | | | |
|---|---|---|---|
| 3,743,258 | 7/1973 | Florentine | 261/95 |
| 3,940,460 | 2/1976 | Graybill | 261/121.3 |
| 3,942,493 | 3/1976 | Linder et al. | 261/121.4 |
| 4,010,723 | 3/1977 | Suzuki et al. | 261/121.4 |
| 4,090,485 | 5/1978 | LaCreta | 123/522 |
| 4,223,615 | 9/1980 | Breen et al. | 431/8 |
| 4,320,731 | 3/1982 | Braun et al. | 261/121.4 |

*Primary Examiner*—Richard A. Bertsch
*Assistant Examiner*—Timothy S. Thorpe
*Attorney, Agent, or Firm*—Patrick L. Scanlon; Paul R. Webb, II

[57] ABSTRACT

Reducing $NO_x$ emission levels from a gas turbine combustor having a premixer section by mixing a small portion of air into the fuel prior to injection into the premixer section. The portion of diverted air is approximately five percent of the total amount of air injected into the premixer section or such that the resulting fuel-air mixture in the fuel line is approximately half fuel and half air. The injection of air into the fuel line, referred to as "head start partial premixing," is effective to reduce the fluctuations and nonuniformities in the fuel concentration levels which increase $NO_x$ output.

5 Claims, 3 Drawing Sheets

HEAD START PARTIAL PREMIXING FOR REDUCING OXIDES OF NITROGEN EMISSIONS IN GAS TURBINE COMBUSTORS

BACKGROUND OF THE INVENTION

This invention relates generally to minimizing $NO_x$ production in gas turbine combustors and more particularly concerns reducing $NO_x$ emissions by mixing a small portion of combustion air into the fuel lines upstream of the premixer section of the combustor.

Hydrocarbons are widely used as fuels in gas turbine combustors. Because of its projected widespread availability, natural gas is an especially attractive fuel for stationary power generating systems. However, the emissions from the combustion of hydrocarbons lead to many environmental problems such as acid rain, ozone depletion and the "greenhouse" effect. Combustion by-products which pollute the atmosphere are required to be minimized as part of a growing concern for the quality of the environment. Oxides of nitrogen ($NO_x$) are particularly undesirable by-products.

During combustion, $NO_x$ is formed in part by reactions which occur between atmospheric nitrogen and oxygen atoms. Because of the high activation energy of these reactions, $NO_x$ formation is not significant at temperatures below approximately 1800 K. to 1900 K. The requirement of high temperatures has led to water or steam injection for $NO_x$ control in conventional (non-premixed) combustors. In this approach, the injected water or steam absorbs heat, reduces the peak temperatures below the $NO_x$-forming threshold, and so reduces $NO_x$ formation. However, this approach is expensive in terms of water or steam, can cause corrosion, and can increase carbon monoxide emission levels. Another common approach, injecting ammonia-based thermal de$NO_x$ into the exhaust stream, minimizes $NO_x$, but this method is very expensive in terms of capital equipment and process ammonia.

Lean premixed combustion of gaseous hydrocarbons is an attractive approach because it offers relatively clean combustion without the need for post-combustion treatment of the exhaust. Typically, lean premixed combustion is accomplished by premixing fuel and air just upstream of flame stabilization (in a section of the combustor called the premixer section) to form a mixture on the lean side of stoichiometric. The effect of premixing is to reduce and hopefully minimize the temperature at which the mixture burns, thus reducing $NO_x$ production which is temperature sensitive. Generally, the leaner the mixture, the lower the combustion temperature will be.

The premixer sections of combustors used in industry typically fall short of completely mixing the gaseous fuel and air, thus resulting in higher levels of $NO_x$. Efforts to improve the "mixedness" of fuel and air within the premixer by altering geometries and flow patterns have been attempted. However practical designs are constrained by such factors as allowable pressure drop limits and space limitations. Despite improvements in premixer designs, some incomplete mixing generally exists. Incomplete mixing leads to nonuniformities and fluctuations in fuel concentration levels during lean premixed combustion. Such nonuniformities and fluctuations cause increased $NO_x$ production because $NO_x$ production increases nonlinearly with the fuel concentration. For example, a fluctuation above the average fuel concentration will add more $NO_x$ than an equal fluctuation below the average fuel concentration will reduce. The net effect is that fluctuations produce more $NO_x$ than if combustion was performed at a constant fuel concentration. Similarly, nonuniform mean profiles contribute to greater $NO_x$.

SUMMARY OF THE INVENTION

Accordingly, it is an object of the present invention to reduce $NO_x$ emissions by minimizing fluctuations and nonuniformities in the fuel concentration levels of fuel-air combustion mixtures.

More specifically, it is an object of the present invention to reduce $NO_x$ emissions in lean premixed combustion by mixing a small portion of air with the fuel upstream of the premixing stage.

In addition, it is an object of the present invention to provide $NO_x$ reduction in lean premixed combustion that is useful regardless of the combustor design and does not require major modification of the combustor.

These and other objects are accomplished in the present invention by a process referred to as "head start partial premixing." Head start partial premixing reduces $NO_x$ emission levels from a gas turbine combustor by mixing a small portion of air (typically around one to ten percent of the total combustion air supply) into the fuel line prior to injection into the combustor. Although a non-premixing combustor is possible, the present invention preferably provides a gas turbine apparatus comprising a combustor having a premixer section for mixing fuel and air. A fuel line is connected to a first inlet for supplying fuel to the premixer section, and a source of air is connected to a second inlet of the premixer section. A means for injecting air into the fuel line upstream of said premixer section comprises means for diverting a small portion of air from the source of air to the fuel line.

The present invention will be useful with any combustor that has imperfect mixing, regardless of its design. Furthermore, the present invention does not require expensive modifications of the combustor. The invention does not pose a safety problem because the head start partial premixing occurs relatively far upstream from the combustor and the fuel-air mixture in the fuel line is kept very rich (beyond the flammability limit) and therefore is not combustible.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

The present invention relies on the concept that mixing a small portion of air with fuel prior to injection into the premixer section of a combustor minimizes $NO_x$ production by reducing fluctuations and nonuniformities in the net mean fuel concentration level of the mixture of the premixer section. The theory behind this concept will be shown by comparing a typical premixed combustor with the combustor of the present invention.

Figure 1:
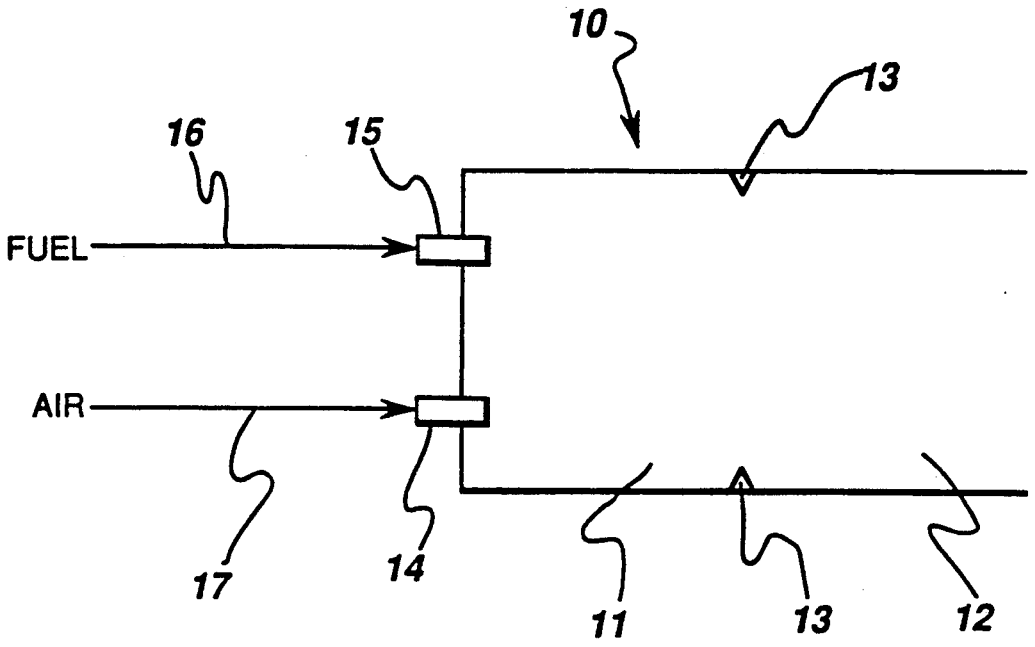
FIG. 1 is a schematic view of a conventional combustor for premixed combustion.

FIG. 1 shows a schematic of a conventional combustor 10 for carrying out lean premixed combustion. The combustor 10 has a premixer section 11 where injected fuel and air are mixed and a combustion section 12 where the fuel-air mixture is burned. A flame stabilizer 13 separates the combustion and premixer sections. Two input ports 14 and 15 provide inlets to the premixer section 11. These ports can be configured in any well known manner. A fuel line 16 is connected to the second input port 15 for supplying fuel to the premixer section. A second line 17 is connected to the first input port 14. The second line 17 provides air to the premixer section 11 through the first input port.

The volumetric fuel concentration of a stream delivered through the first input port 14 is given by $C_1$ and the volumetric fuel concentration of a stream delivered through the second input port 15 is given by $C_2$. Since the stream through first input port 14 is entirely air and the stream through the second input port is entirely fuel, $C_1=0$ and $C_2=1$. The net mean fuel concentration of the mixture of the two streams is given by C, where $$C_1 \leqq C \leqq C_2.$$

The maximum variance, $\sigma_{max}^2$, in the net mean fuel concentration, C, of the mixture of the premixer section is given by:

$$\sigma_{max}^2=(C_2-C)(C-C_1). \quad (1)$$

The variance is an indication of the magnitude of the fluctuations in fuel-air concentration. As an example, consider a combustion process where the fuel is methane. For methane, the net mean fuel concentration is given by:

$$C=\frac{\phi}{(\phi+9.52)}$$

where $\phi$ is the fuel-air equivalence ratio. For the case where the fuel-air equivalence ratio is 0.5, C will be approximately 0.05 and solving equation 1 gives $\sigma_{max}^2=0.0475$.

Figure 2:
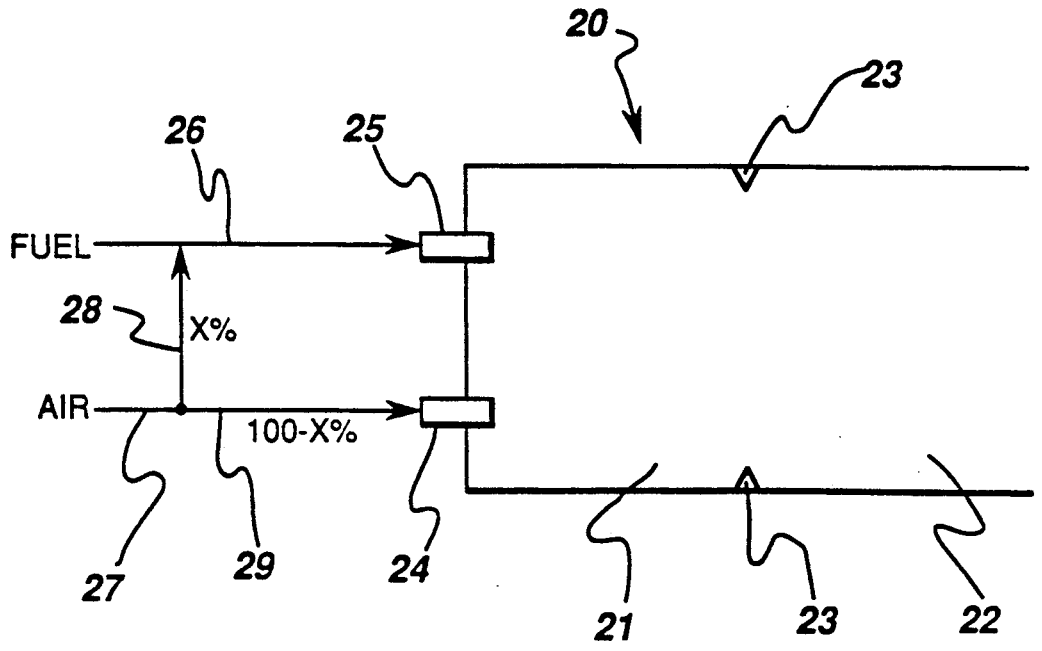
FIG. 2 is a schematic view of the combustor of the present invention.

Turning now to FIG. 2, the combustor 20 of the present invention is shown schematically. Like the combustor 0 of FIG. 1, the combustor 20 has a premixer section 21 where injected fuel and air are mixed and a combustion section 22 where the fuel-air mixture is burned. A flame stabilizer 23 separates the combustion and premixer sections. Two input ports 24 and 25 provide inlets to the premixer section 21. A fuel line 26 is connected to the second input port 25 for supplying fuel to the premixer section. A second line 27 is connected to the first input port 24. The second line 27 is split into two branches 28 and 29. The first branch 28 delivers a small percentage, X, of the total air from line 27 to the fuel line 26, thereby causing the small portion of air to be mixed with the fuel prior to injection into the premixer section 21. The remainder of the air from the line 27 is directly delivered to the premixer section via the second branch 29 which is connected to the first input port 24.

Now reconsider the above example of combusting methane at a fuel-air equivalence ratio of 0.5 where head start premixing is used in the combustor 20. Assume that the volume of air diverted from the second line 27 to the fuel line 26 is five percent of the total. Now the stream through first input port 24 is still entirely air, but the stream through the second input port is a mixture of fuel and air. Since, for an equivalence ratio of 0.5, the net mean fuel concentration, C, is approximately 0.05, the mixture of fuel and air injected through the second input port 25 is half fuel and half air. Thus, $C_1=0$ and $C_2=0.5$ and equation 1 now gives $\sigma_{max}^2=0.0225$. It can be seen from this comparison that head start partial premixing has reduced the maximum variance by more than 50 percent which means fluctuations and nonuniformities are reduced.

The amount of air injected into the fuel line is constrained in part by safety considerations. Ideally, as much air as possible is added because more air lowers the value of the fuel concentration, $C_2$ through the second input port and the maximum variance possible is directly related to the value of $C_2$. However, the fuel-air mixture in the fuel line 26 must be maintained very rich, beyond its flammability limit, or else combustion could occur in the fuel line; adding too much air to the fuel line could produce a flammable mixture. Other considerations include practical aspects of the system design such as required changes in fuel lines and fuel injectors and any additional air compression needed prior to injecting diverted air into the fuel line. Generally, an amount in the range of approximately one to ten percent of the total air volume is considered practical.

The first branch 28 should be arranged to inject the small portion of air into the fuel line 26 at a point far upstream of the combustor 20. Not only does the distance from the combustor help prevent combustion in the fuel line, but the considerable distance the fuel-air mixture must travel through the fuel line results in thorough mixing.

Figure 3:
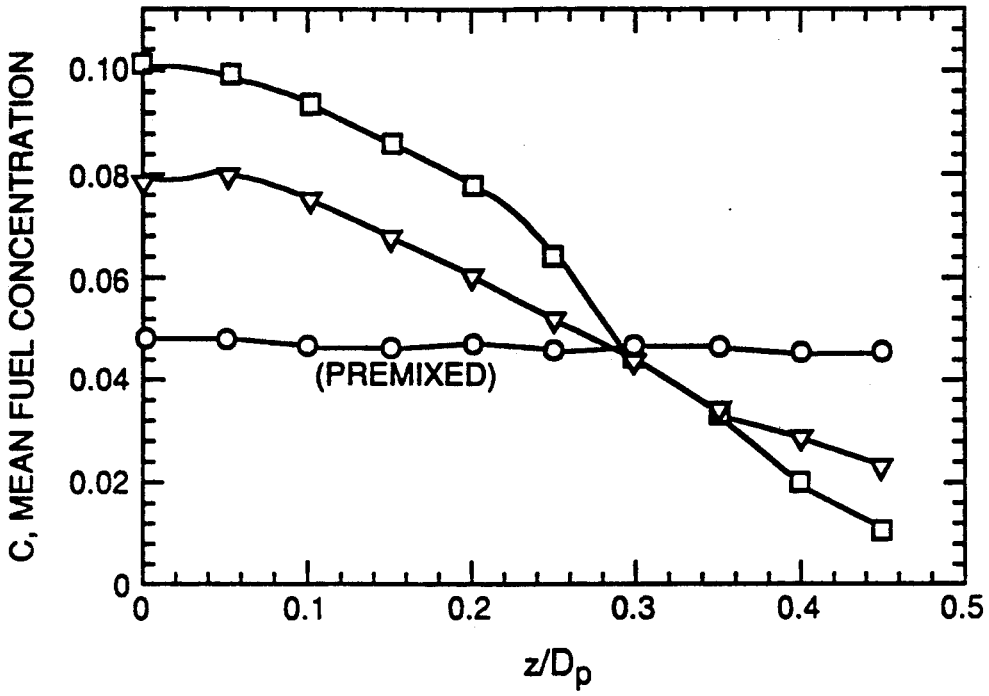
FIG. 3 is a graph comparing experimental mean fuel concentrations.
Figure 4:
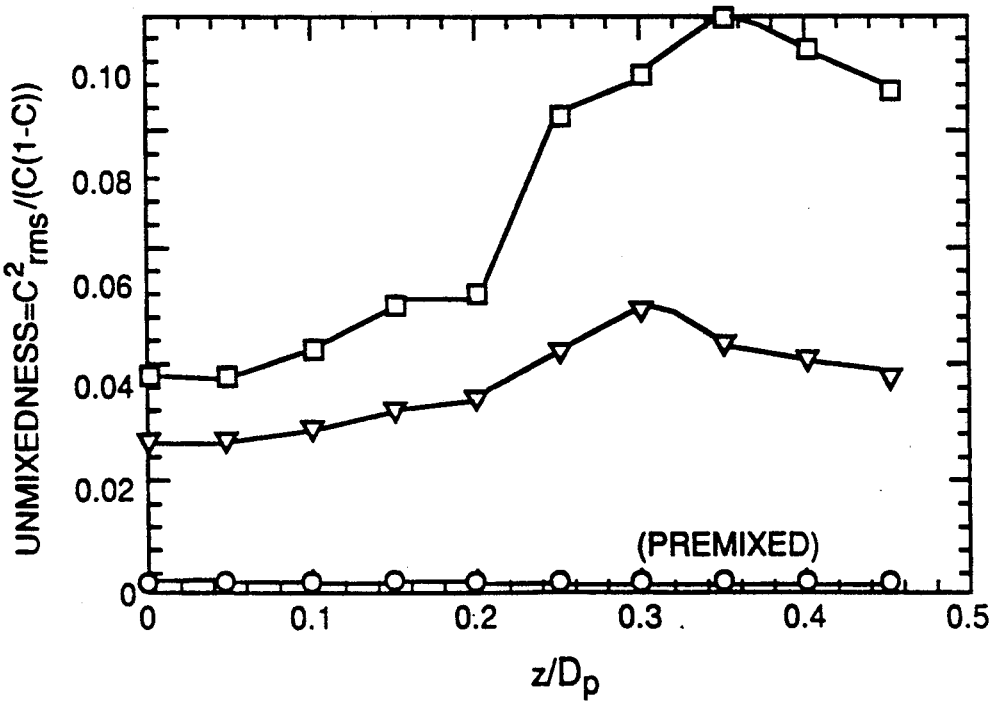
FIG. 4 is a graph comparing experimental "unmixedness" levels.
Figure 5:
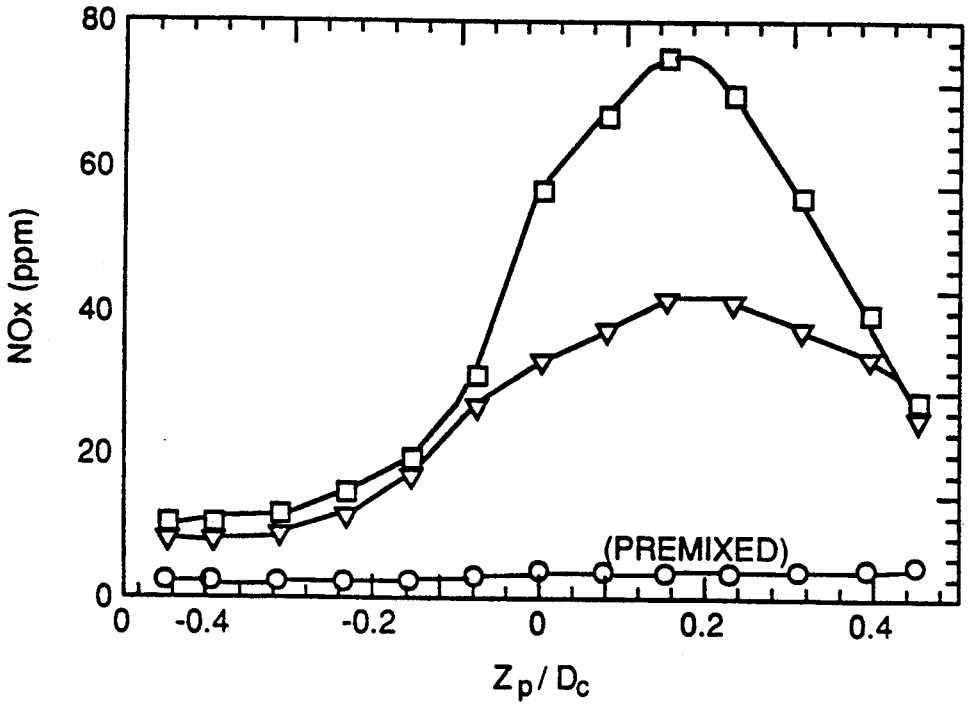
FIG. 5 is a graph comparing experimental $NO_x$ emission levels.

FIGS. 3–5 show the results of experiments carried out to test the concept of the present invention. A first experiment was conducted on a laboratory-scale device consisting of a premixer tube and a combustion tube joined together at respective ends. A center jet was coaxially disposed in the distal end of the premixer tube. A supply of air was provided to the premixer tube from a point upstream of the center jet. The juncture of the two tubes served as the flame stabilization location. During operation, the mean and fluctuating fuel concentrations were measured at the exit plane of the premixer and $NO_x$ emissions data were taken with a Beckman $NO_x$ analyzer located downstream in the combustion tube.

Two combustion processes were conducted. In both instances methane was used for the fuel and the equivalence ratio was 0.5. In the first run methane was injected through the center jet and an air flow was provided in the premixer tube. Next, five percent by volume of the air flow was diverted from the premixer tube into the jet. The center jet was then essentially a 50—50 mix of air and methane. This represents the head start partial premixing concept of the present invention. For a reference, data representing an essentially perfectly mixed case were collected. (Note that the laboratory technique used to create the ideal premixed data could not be realized in an actual gas turbine apparatus.) In FIGS. 3–5, circles correspond to data for the ideal premixed case, squares correspond to data from the first run, and triangles correspond to data from the run using head start partial premixing.

FIG. 3 shows a graph plotting the volumetric mean fuel concentration at the end of the premixer tube against the radial distance, z, from the longitudinal axis of the premixer tube, nondimensionalized by the diameter of the premixer tube, $D_p$. The concentration profile where a fuel-air mixture was injected through the center jet was more uniform and closer to the ideal mixed case than the concentration profile where only fuel was injected through the center jet.

FIG. 4 shows a graph plotting the "unmixedness" level against the radial distance, z, from the longitudinal axis of the premixer tube, nondimensionalized by the diameter of the premixer tube, $D_p$. The "unmixedness" level is defined as the variance of fuel-air concentration nondimensionalized by the value (1-C)C. (Note that the most unmixed case is such that the variance equals (1-C)C. Therefore, an unmixedness of 1 would correspond to the most unmixed case, and an unmixedness of 0 would correspond to the most mixed case.) The graph shows that the combustion run using head start partial premixing had a lower unmixedness level than combustion without head start partial premixing.

FIG. 5 plots $NO_x$ production in parts per million against the radial position of the probe, $Z_p$, nondimensionalized by the diameter of the combustion tube, $D_c$. Here, the graph shows that using head start partial premixing provides a substantial improvement in $NO_x$ emissions.

A second test procedure was conducted on a full-scale, single-can combustor. The fuel used was natural gas; the air-fuel mass ratio was about 1 (volume ratio of about 0.56), corresponding to a diversion of about two percent of the combustion air flow. The results showed that $NO_x$ emission reductions of about 20–25 percent from an initial level of 30 parts per million were possible.

The foregoing has described reducing $NO_x$ production in gas turbine combustors by injecting a small portion of air into the fuel supply prior to injection into the premixer section of the combustor. The present invention can be implemented without significant modification to the combustor and is useful regardless of the combustor design.

While specific embodiments of the present invention have been described, it will be apparent to those skilled in the art that various modifications thereto can be made without departing from the spirit and scope of the invention as defined in the appended claims.

What is claimed is:

1. A gas turbine apparatus comprising:
   - a combustor having a premixer section for mixing fuel and air;
   - an air intake for delivering air directly into said premixer section;
   - a fuel line for supplying fuel to said premixer section; and
   - injection means for diverting a portion of the air from said air intake into said fuel line upstream of said premixer section.

2. The gas turbine apparatus of claim 1 wherein said premixer section includes first and second inlets, said fuel line being connected to said first inlet and said air intake being connected to said second inlet.

3. The gas turbine apparatus of claim 1 wherein said portion of air is approximately one to ten percent of the total amount of air delivered to said premixer section.

4. A method of reducing $NO_x$ emissions from a gas turbine combustor having a premixer section into which fuel and air are injected for mixing, said method comprising mixing approximately one to ten percent of the total amount of air into the fuel prior to injection into the premixer section.

5. A gas turbine apparatus comprising:
   - a combustor having a premixer section for mixing fuel and air, said premixer section having first and second inlets;
   - a fuel line connected to said first inlet for supplying fuel to said premixer section; and
   - an air intake line having first and second branches, said first branch being connected to said fuel line for injecting a portion of the air from said air intake line into said fuel line, said second branch being connected to said second inlet for delivering the remaining portion of the air from said air intake line into said premixer section.

* * * * *